US011489297B2

(12) United States Patent
Houir Alami

(10) Patent No.: US 11,489,297 B2
(45) Date of Patent: Nov. 1, 2022

(54) ELECTRICAL CONNECTION MOUNT COMPRISING A MOVABLE CONNECTION ELEMENT, COMPLEMENTARY ELECTRICAL CONNECTION MOUNT, AND ASSEMBLY COMPRISING SUCH MOUNTS

(71) Applicant: MARECHAL ELECTRIC, Saint-Maurice (FR)

(72) Inventor: Mounim Houir Alami, Paris (FR)

(73) Assignee: MARECHAL ELECTRIC, Saint-Maurice (FR)

( * ) Notice: Subject to any disclaimer, the term of this patent is extended or adjusted under 35 U.S.C. 154(b) by 0 days.

(21) Appl. No.: 16/625,954

(22) PCT Filed: Jun. 26, 2018

(86) PCT No.: PCT/FR2018/051550
§ 371 (c)(1),
(2) Date: Dec. 23, 2019

(87) PCT Pub. No.: WO2019/002748
PCT Pub. Date: Jan. 3, 2019

(65) Prior Publication Data

US 2020/0161815 A1 May 21, 2020

(30) Foreign Application Priority Data

Jun. 26, 2017 (FR) ..... 1755814

(51) Int. Cl.
*H01R 13/71* (2006.01)
*H01R 13/625* (2006.01)
(Continued)

(52) U.S. Cl.
CPC ..... *H01R 13/71* (2013.01); *H01R 13/625* (2013.01); *H01R 13/62916* (2013.01); *H01R 13/641* (2013.01)

(58) Field of Classification Search
None
See application file for complete search history.

(56) References Cited

U.S. PATENT DOCUMENTS 3,853,376 A * 12/1974 Marechal ..... H01R 13/645 439/139
4,176,898 A * 12/1979 Marechal ..... H01R 13/447 439/139
(Continued)

FOREIGN PATENT DOCUMENTS

DE 202009004604 U1 6/2009
FR 2466111 A1 3/1981
(Continued)

OTHER PUBLICATIONS

French Search Report from FR Application No. FR1755814, dated Oct. 17, 2017.
(Continued)

*Primary Examiner* — Felix O Figueroa
(74) *Attorney, Agent, or Firm* — Workman Nydegger

(57) ABSTRACT

An electrical connection mount extending along an axial direction and comprising a movable element that can move along the axial direction between a contact position and an insulated position, wherein the movable element is configured to come into contact with at least one complementary contact of a complementary electrical connection mount in the contact position while the movable element is configured to be remote from the at least one complementary contact of the complementary electrical connection mount in the insulated position, the electrical connection mount comprising a displacement mechanism configured to move the movable element between the contact position and the insulated position when the electrical connection mount and the complementary electrical connection mount are engaged
(Continued)

Figure 1:
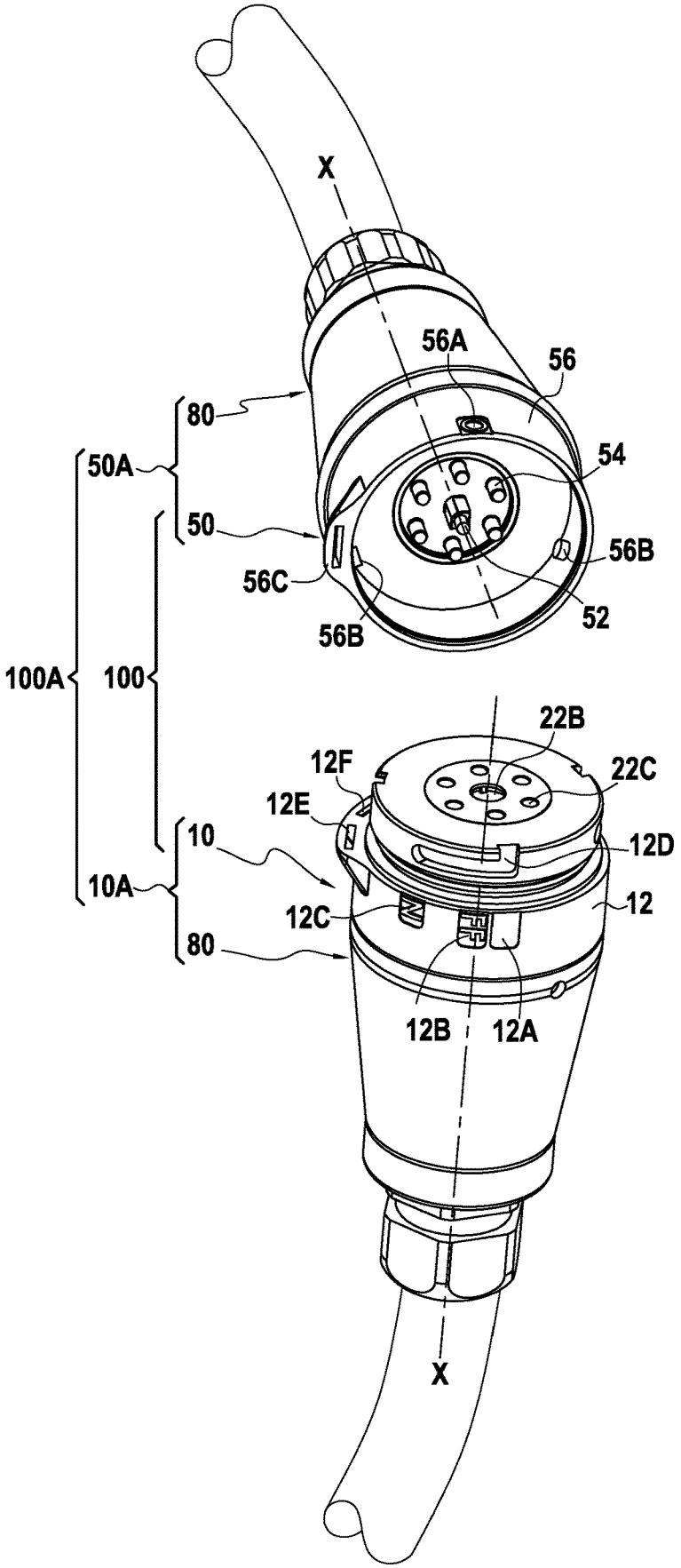

with each other and rotated relative to each other around the axial direction.

16 Claims, 10 Drawing Sheets

(51) Int. Cl.
*H01R 13/629* (2006.01)
*H01R 13/641* (2006.01)

(56) References Cited

U.S. PATENT DOCUMENTS 4,461,523 A 7/1984 Ustin et al.
5,035,635 A * 7/1991 Tsai ..... H01R 13/44 439/188
5,044,977 A 9/1991 Vindigni
5,234,350 A 8/1993 Marechal et al.
5,697,798 A * 12/1997 Marechal ..... H01R 13/4532 439/139
7,740,499 B1 6/2010 Willey et al.
2010/0323542 A1 12/2010 Boucher et al.

FOREIGN PATENT DOCUMENTS

FR 2623945 A1 6/1989
GB 2279825 A 1/1995

OTHER PUBLICATIONS

International Search Report and Written Opinion from PCT Application No. PCT/FR2018/051550, dated Sep. 24, 2018.

* cited by examiner

ELECTRICAL CONNECTION MOUNT COMPRISING A MOVABLE CONNECTION ELEMENT, COMPLEMENTARY ELECTRICAL CONNECTION MOUNT, AND ASSEMBLY COMPRISING SUCH MOUNTS

FIELD OF THE INVENTION

The invention relates to an electrical connection mount, a complementary electrical connection mount as well as an assembly comprising an electrical connection mount and a complementary electrical connection mount. The invention relates in particular to the end-contact mounts, but not only. For example, the electrical connection mount is a socket-outlet while the complementary electrical connection mount is a plug, or vice versa.

STATE OF THE PRIOR ART

Generally, socket-outlets and connectors, in particular for the electric power currents, are designed to prevent the formation of electric arcs and to cut it as quickly as possible. For example, document FR 2 466 111 or FR 2 623 945 disclose mounts having end-contact and comprising a spring system to separate as quickly as possible the socket-outlet and the plug during disconnection.

Such known systems are entirely satisfactory upon disconnection. However, in some cases, electric arcs can be formed upon connection. Furthermore, the springs used to separate the socket-outlet and the plug upon disconnection require, upon connection of the plug and of the socket-outlet, producing a significant force to compress these springs. There is therefore a need within this meaning.

PRESENTATION OF THE INVENTION

The present disclosure relates to an electrical connection mount.

An embodiment relates to an electrical connection mount extending along an axial direction and comprising a movable element along the axial direction between a contact position and an insulated position, wherein the movable element is configured to come into contact with at least one complementary contact of a complementary electrical connection mount in the contact position while the movable element is configured to be remote from the at least one complementary contact of the complementary electrical connection mount in the insulated position, the electrical connection mount comprising a displacement mechanism configured to move the movable element between the contact position and the insulated position when the electrical connection mount and the complementary electrical connection mount are engaged with each other and rotated relative to each other around the axial direction.

Subsequently, and unless otherwise indicated, "complementary contact" means "the at least one complementary contact".

It is understood that the electrical connection mount may be a socket-outlet or a plug, while the complementary electrical connection mount may be a plug or a socket-outlet, respectively.

it is recalled that socket-outlet forms a female portion that may belong to a power connection (where the socket-outlet is generally secured to a wall, a casing or the equivalent), to an extension cord, or to a connector (where the socket-outlet generally forms part of a mobile socket), while a plug forms a male portion that may belong to a power connection (where the plug generally forms part of the movable connection), to an extension cord, or to a connector (where the plug is generally secured to an appliance or the equivalent).

It is also recalled that in general manner, a mobile socket comprises an socket-outlet and a handle or cap secured to said socket-outlet; a movable connection comprises a plug and a handle or cap secured to said plug; an extension cord is an assembly comprising a mobile socket and a movable connection; a power connection is an assembly comprising an socket-outlet and a plug; and a connector is an assembly comprising a mobile socket and a plug. The handle or cap may be incorporated with the socket-outlet or with the plug, in which circumstance said socket-outlet or plug also forms a mobile socket or a movable connection.

Of course, the handle or capping may be integrated to the socket-outlet or to the plug, in which case said socket-outlet or plug also forms a mobile socket or a movable connection.

For example, the electrical connection mount (and therefore the complementary electrical connection mount) is provided with "end" contact(s).

An "end"-type contact is a contact where the electrical connection with a complementary contact, for example a spindle, is ensured by a contact face substantially perpendicular to the axial direction. Such a contact is configured to cooperate in abutment with a complementary face, for example a distal end face of a spindle, the contact between these two faces being generally made with a certain pressure to guarantee the passage of current from one contact to the other.

It is understood that, in the contact position, the movable element is in a position to be in contact with a complementary contact of the complementary electrical connection mount, so that electric current can flow between the complementary contact and the movable element. Conversely, it is understood that, in the insulated position, the movable element is in a position to be remote, along the axial direction, from the complementary contact of the complementary electrical connection mount, so that the electric current cannot flow between the complementary contact and the movable element (i.e. the complementary contact and the movable element are electrically insulated from each other in the insulated position).

Of course, the movable element may comprise several separate portions electrically insulated from each other, each portion being configured to be in electrical contact with a complementary contact separate from a complementary electrical connection mount. It is understood that each portion is respectively in contact, at least in the contact position, with a conductive element connecting the movable element to a corresponding wire clamp of the electrical connection mount. Thus, the movable element may be in permanent contact with the wire clamp(s), or is in contact with the wire clamp(s) only in the contact position.

The displacement mechanism allows moving the movable element along the axial direction, in particular from the insulated position to the contact position and vice versa. It will of course be understood that this displacement mechanism is actuated when the electrical connection mount and the complementary electrical connection mount are engaged with each other (i.e. cooperate together), and when the one is rotated relative to the other. By actuating this mechanism, the movable element is moved from the insulated position to the contact position, and vice versa. Of course, the displacement mechanism is configured to cooperate with an actuator of the complementary electrical connection mount, said actuator being configured to actuate the displacement mechanism.

Thanks to the axial displacement of the movable element and to the displacement mechanism, the connection and disconnection between the platen (and therefore the active portions of the electrical connection mount—i.e. the portions under electrical voltage), and the complementary contact(s) of the complementary electrical connection mount are perfectly controlled. Thus, the formation of electric arcs is controlled and therefore prevented or, at the very least, limited, both upon connection and upon disconnection. Moreover, unlike the devices of the state of the art, to engage the electrical connection mount and the complementary electrical connection mount, it is not necessary to provide a significant force. Indeed, in the devices of the state of the art upon engagement of the mounts, which is concomitant with the electrical connection of the contacts, it is necessary to provide a significant force to compress a spring system used to separate as quickly as possible both mounts upon disconnection.

In some embodiments, the displacement mechanism comprises an axially extending shaft rotatably mounted around the axial direction on a base, the shaft comprising one element among a helical ramp and a lug, the movable element having the other element among the helical ramp and the lug, the lug cooperating with the helical ramp.

It is therefore understood that the electrical connection mount comprises a base and a shaft extending along the axial direction, the shaft being mounted on the base by a pivot connection. It is also understood that the shaft has at least a first axial wall, this first axial wall having for example a cylindrical shape or a shape of an angular cylinder portion. Similarly, it is understood that the movable element has at least a second axial wall, this second axial wall having for example a cylindrical shape or a shape of an angular cylinder portion. The first and second axial walls are disposed at least partly opposite each other.

Thus, according to a first variant, the first axial wall of the shaft has a helical ramp while the second axial wall of the movable element has a lug. According to a second variant, the first axial wall of the shaft has a lug while the second axial wall of the movable element has a helical ramp. For example, the helical ramp is formed by a wall of a helical groove arranged in the first or second axial wall. According to another example, the helical ramp is formed by a helical shoulder formed on the first or on the second axial wall. This helical ramp is configured to cooperate in axial abutment with the lug, whereby an axial translation movement is impelled to the movable element during the rotation of the shaft around the axial direction. Of course, the movable element is rotatably blocked around the axial direction, whereby it cannot be rotatably driven by the shaft but only in translation along the axial direction.

A displacement mechanism having such a helical ramp structure is simple, robust and efficient, and allows a very good control of the axial displacement of the movable element, and therefore of the electric arcs. Such a helical ramp mechanism also allows multiplying the forces for the passage of the movable element between the insulated position and the contact position, and vice versa, which makes its manipulation by a user easier.

For example, the shaft is a central shaft, but not necessarily. A central shaft allows further simplifying the structure of the displacement mechanism, which makes the control of electric arcs more reliable.

In some embodiments, the shaft is configured to cooperate in a form-fitting manner with a complementary element of the complementary electrical connection mount and to be rotatably driven around the axial direction by the complementary element of the complementary electrical connection mount.

It is therefore understood that, when the electrical connection mount and the complementary electrical connection mount are engaged with each other, the shaft cooperates, for example by fitting, with the complementary element, comprising for example a rod. For example, the shaft is hollow and receives the rod, or vice versa. For example, the shaft and the rod are central, the shaft and the rod having complementary reliefs so that they are rotatably coupled around the axial direction when they are fitted with each other along the axial direction. According to another example, the rod is eccentric and has no rotatably coupling relief with the shaft so that a fitting of the rod with the shaft allows them to be rotatably coupled. Thus, the relative rotation of the electrical connection mount and of the complementary electrical connection mount around the axial direction allows the complementary element to rotatably drive the shaft around the axial direction, and therefore to actuate the displacement mechanism to axially move the movable element. Such a structure for actuating the displacement mechanism is simple, robust and efficient, and allows a very good control of the axial displacement of the movable element, and therefore of the electric arcs.

In some embodiments, the displacement mechanism comprises an indexing device.

It is of course understood that such an indexing device is configured to cooperate with a complementary indexing device of the complementary electrical connection mount. For example, the shaft has a flat or an asymmetrical shape of revolution authorizing, considered along the azimuth direction, only one position of cooperation in a form-fitting manner with the complementary element. In the case where the movable element is configured to contact a plurality of complementary contacts separate from a complementary electrical connection mount, this allows ensuring that the displacement mechanism can be actuated only if the relative position of the electrical connection mount and of the complementary electrical connection mount is such that the complementary contacts will be in contact with the corresponding portions of the movable element. In other words, this allows ensuring that, in the contact position, each phase of the electrical connection mount will indeed be contacted with the corresponding phase of the complementary electrical connection mount. Furthermore, by providing different indexing devices according to the models of electrical connection mounts, this avoids contacting an electrical connection mount with a complementary electrical connection mount of different polarity, voltage, frequency or amperage/intensity. This allows improving safety and avoiding, at the very least limiting, the formation of particularly damaging electric arcs.

In some embodiments, the electrical connection mount comprises a device for holding in position the movable element.

It is therefore understood that the holding device allows holding, without necessarily locking, the movable element in the insulated position or in the contact position. It is thus ensured that the movable element is moved axially between these two positions only if the displacement mechanism is actuated voluntarily. Such a device allows avoiding, at the very least limiting, possible unwanted displacements of the movable element, and therefore the loss of electrical contact (in the contact position) or the formation of possible electric arcs (in the insulated position).

In some embodiments, the device for holding in position the movable element comprises a cam carried by the shaft, and a pressing element cooperating with the cam.

It is understood that the pressing element exerts pressure on the cam so as to hold it in a predefined position. Thus, the pressing element exerts pressure on the cam to hold it in a first position corresponding to the insulated position of the movable element and/or to hold it in a second position corresponding to the contact position of the movable element. Such a structure of the holding device comprises a cam and a pressing element is a simple, robust and efficient structure, which allows a very good control in holding the movable element in the insulated position or in the contact position in a stable, reliable and accurate manner. This allows the control of the electric arcs.

In some embodiments, the electrical connection mount has a first stable configuration in which the movable element is in the contact position, a second stable configuration in which the movable element is in the insulated position, and a plurality of unstable intermediate configurations between the first configuration and the second configuration in which the electrical connection mount tends to come into the first configuration or into the second configuration.

Of course, it is understood that a stable configuration is a configuration more stable than the unstable configurations, and conversely, the unstable configurations are configurations that are less stable than the stable configurations. In other words, it is understood that the stable configurations are configurations taken by default by the electrical connection mount, while the unstable configurations are transient configurations and cannot be taken by default by the electrical connection mount.

It is ensured that all the intermediate positions of the movable element between the cutoff position and the contact position correspond to unstable configurations of the electrical connection mount. Thus, for example, if the electrical connection mount were to undergo an involuntary operation resulting in actuating the displacement mechanism, leaving it in an intermediate and therefore unstable configuration, it is ensured that the electrical connection mount will automatically resume the first or second configuration. According to another example, if a user actuated only partially the displacement mechanism, leaving the electrical connection mount in an intermediate and therefore unstable configuration, it is ensured that the electrical connection mount would automatically resume the first or the second configuration. This allows avoiding, at the very least limiting, the formation of electric arcs.

In some embodiments, the movable element comprises a plurality of contacts configured to contact the at least one complementary contact of the complementary electrical connection mount, the relative angular travel between the electrical connection mount and the complementary electrical connection mount to move the movable element between the insulated position and the contact position being less than the minimum angle separating two adjacent contacts.

It is understood that each contact is configured to contact a separate complementary contact. For example, there are as many contacts as there are complementary contacts, but not necessarily. It is also understood that at least two contacts are distributed azimuthally around the axial direction. For example, all contacts are azimutally distributed around the axial direction. According to another example, the contacts are evenly distributed along the azimuth direction (i.e. the angle between two adjacent contacts is identical for all contacts).

Generally, it is understood that the azimuth direction is a direction describing a ring around the axial direction. This direction therefore corresponds to the direction of relative rotation of the electrical connection mount relative to the complementary electrical connection mount to axially move the movable element.

It is also understood that the angle necessary for rotating the electrical connection mount relative to the complementary electrical connection mount to actuate the displacement mechanism and bring the movable element from the insulated position to the contact position, and conversely, is less than the minimum angle separating two adjacent contacts (along the azimuth direction, around the axial direction). The angles are of course measured around the axial direction, in a plane perpendicular to the axial direction (i.e. in the relative plane of rotation of the two mounts).

With such a configuration, it is ensured that, during the relative rotational movement between the electrical connection mount and the complementary electrical connection mount to axially move the movable element, there is no risk that a contact ends up close to or opposite a complementary contact which would not correspond thereto (i.e. with which the contact is not intended to come into contact). There is therefore no risk that in the contact position, a contact of the electrical connection mount contacts a complementary contact of the complementary electrical connection mount that would not correspond thereto. This makes it possible to avoid the formation of unwanted electric arcs between separate phases of the socket-outlet and of the plug and to secure the connection of the phases of the electrical connection mount and of the complementary electrical connection mount.

In some embodiments, the movable element comprises at least one contact configured to contact the at least one complementary contact of the complementary electrical connection mount, and the electrical connection mount comprising a safety disc rotatably movable between a protection position preventing access to said at least one contact and a connection position authorizing access to said at least one contact.

It is understood that the safety disk is rotatably movable around the axial direction. Such a disk allows blocking access to the contact(s). This allows improving safety by blocking access to the active portions of the electrical connection mount. This also allows avoiding the unwanted formation of electric arcs when approaching the electrical connection mount and the complementary electrical connection mount, in particular to engage them with each other. According to one variant, the safety disk is carried by the complementary electrical connection mount and authorizes or prevents access to the complementary contact.

In some embodiments, the safety disk is rotatably coupled with the shaft.

Thus, when the shaft of the displacement mechanism is rotatably driven, the safety disk is also rotatably driven. This makes it possible to synchronize the displacement of the movable element and of the safety disc, which increases safety and decreases the risk of unwanted formation of electric arcs.

In some embodiments, the electrical connection mount comprises at least two separate position indicators configured to indicate the relative azimuth position of the electrical connection mount relative to the complementary electrical connection mount.

For example, such indicators are used in combination, when the electrical connection mount is engaged with a complementary electrical connection mount, with an index.

This allows the user to know perfectly the relative azimuth position of the electrical connection mount relative to the complementary electrical connection mount, and therefore the associated position of the movable element and, consequently, the connected or unconnected state of the contacts of the electrical connection mount with the complementary contacts of the complementary electrical connection mount. The user can thus avoid any false manipulation. This increases safety and decreases the risk of unwanted formation of electric arcs.

The present disclosure also relates to a complementary electrical connection mount.

An embodiment relates to a complementary electrical connection mount extending along an axial direction and comprising an actuator configured to actuate a displacement mechanism of a movable element of an electrical connection mount when the complementary electrical connection mount and the electrical connection mount are engaged with each other and rotated relative to each other around the axial direction. Of course, the movable element of the electrical connection mount is movable along the axial direction between a contact position and an insulated position, and configured to establish an electrical contact with at least one complementary contact of the complementary electrical connection mount in the contact position while the movable element is configured to be remote from the at least one complementary contact of the complementary electrical connection mount in the insulated position.

It is therefore understood that such a complementary electrical connection mount is complementary to the electrical connection mount object of the present disclosure and that the actuator makes it possible to actuate the displacement mechanism of the electrical connection mount to switch the movable element from the contact position to the insulated position, and vice versa. Thus, when the actuator cooperates with the displacement mechanism, it is considered that the electrical connection mount and the complementary electrical connection mount are engaged with each other. The relative rotation of the electrical connection mount relative to the complementary electrical connection mount around the axial direction thus makes it possible to actuate the displacement mechanism and therefore to move the movable element between the insulated position and the contact position.

In some embodiments, the actuator is configured to cooperate in a form-fitting manner with an axially extending shaft of the displacement mechanism of the electrical connection mount and to rotatably drive the shaft around the axial direction.

For example, the actuator comprises a rod. The rod may be central, but not necessarily. For example, the rod may be a spindle. It should be noted that a central spindle is generally, but not systematically, a spindle used for ground connection, such a spindle being known to those skilled in the art as the spindle used for ground continuity or as earth contact spindle. The central spindle is generally different from the other possible spindles (or peripheral spindles) of the complementary electrical connection mount.

In some embodiments, the actuator includes an indexing device.

It is of course understood that such an indexing device is configured to cooperate with a complementary indexing device of the electrical connection mount. For example, the rod has a flat forming the indexing device.

In some embodiments, the complementary electrical connection mount comprises an index configured to indicate the relative azimuth position of the complementary electrical connection mount relative to the electrical connection mount.

For example, such an index is pointed, when the complementary electrical connection mount is engaged with an electrical connection mount, to a position indicator. This allows the user to know perfectly the relative azimuth position of the complementary electrical connection mount relative to the electrical connection mount, and therefore the associated position of the movable element and consequently the connected or unconnected state of the contacts of the electrical connection mount with the complementary contacts of the complementary electrical connection mount. The user can thus avoid any false manipulation. This increases safety and decreases the risk of unwanted formation of electric arcs.

The present disclosure also relates to an assembly comprising an electrical connection mount according to any one of the embodiments described in the present disclosure and a complementary electrical connection mount according to any one of the embodiments described in the present disclosure.

SHORT DESCRIPTION OF THE DRAWINGS

Figure 2:
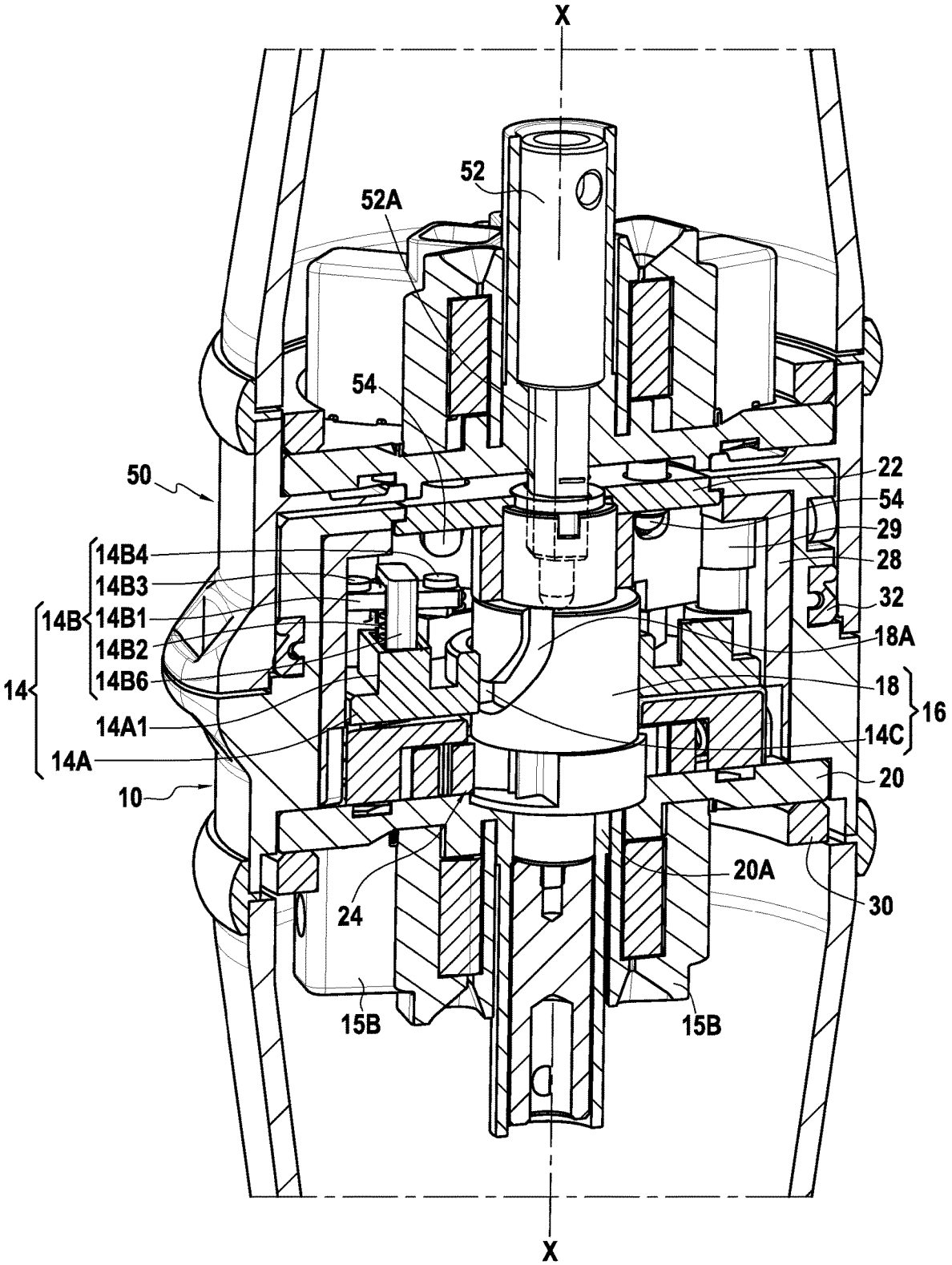

The invention and its advantages will be better understood upon reading the detailed description given below of various embodiments of the invention given as non-limiting examples. This description refers to the pages of appended figures, in which:

FIG. 1 represents an assembly comprising a socket-outlet and a plug, separated from each other, according to a first embodiment, FIG. 2 represents a sectional view of the socket-outlet and of the plug of FIG. 1, engaged with each other.

Figure 3:
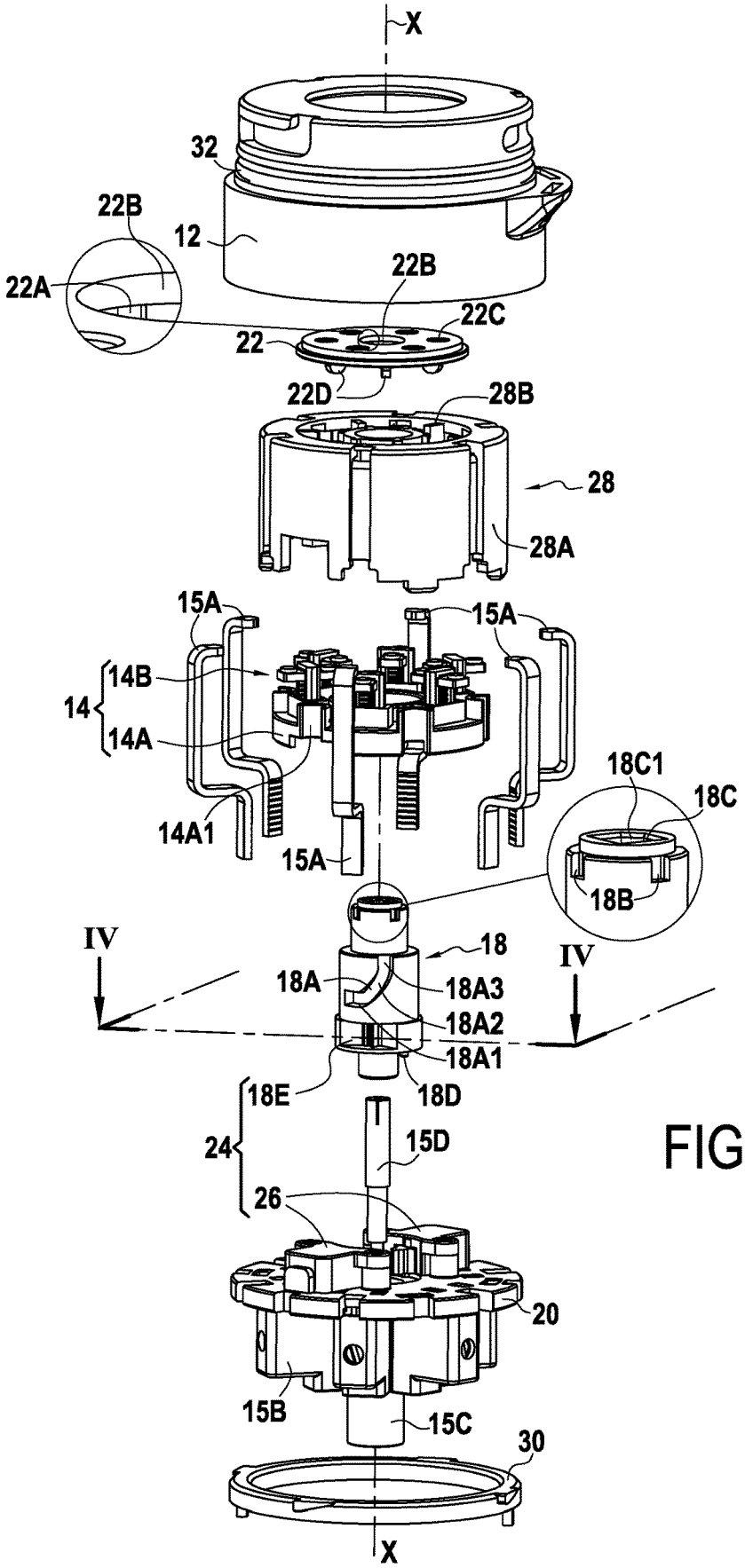
Figure 4:
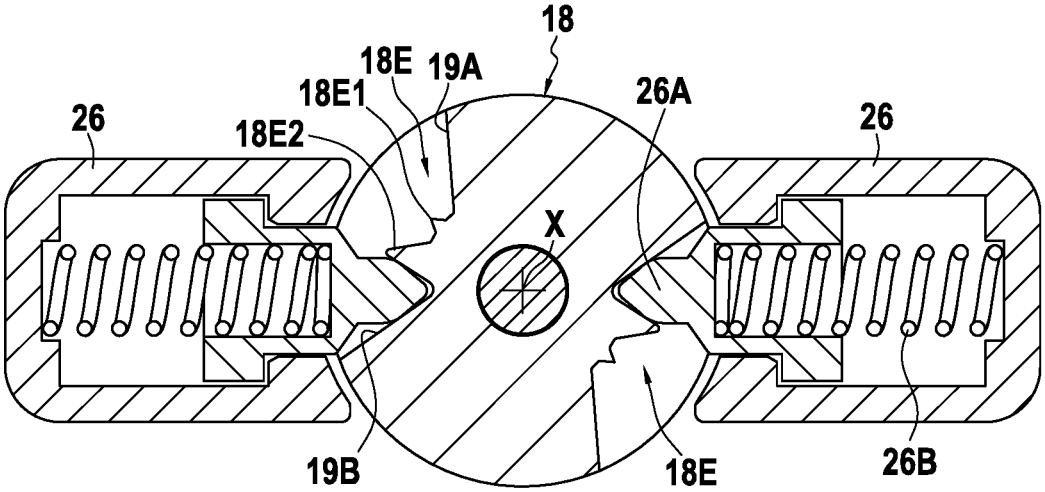
Figure 5B:
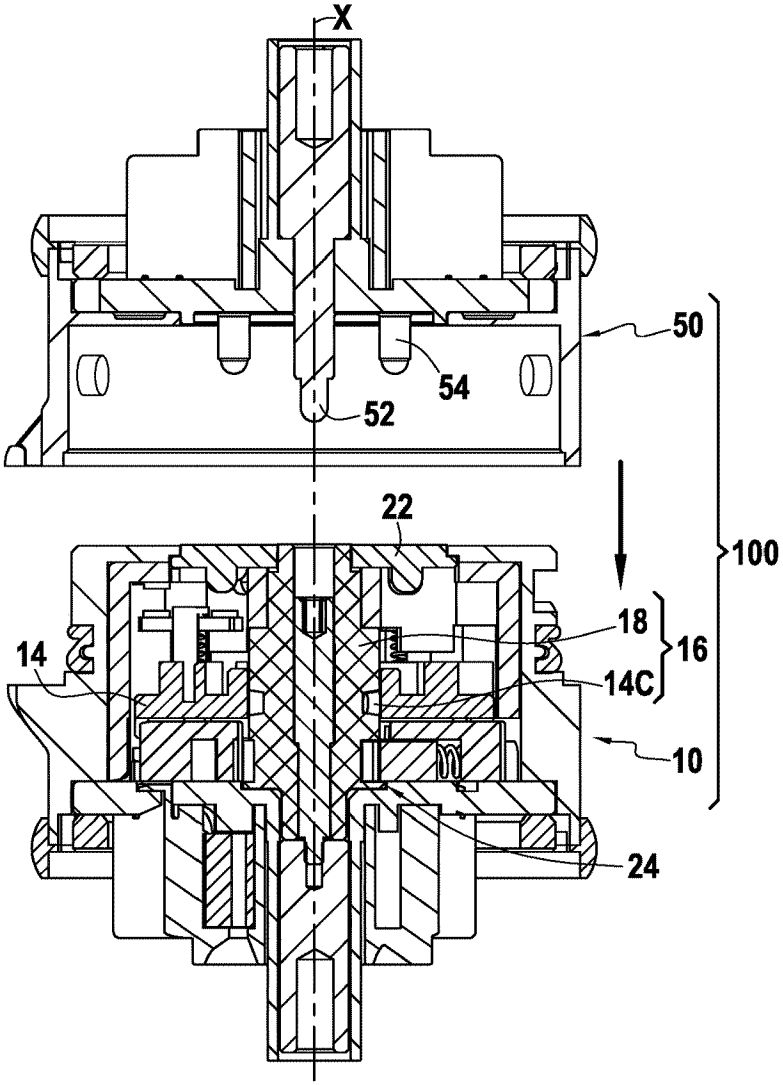
Figure 5A:
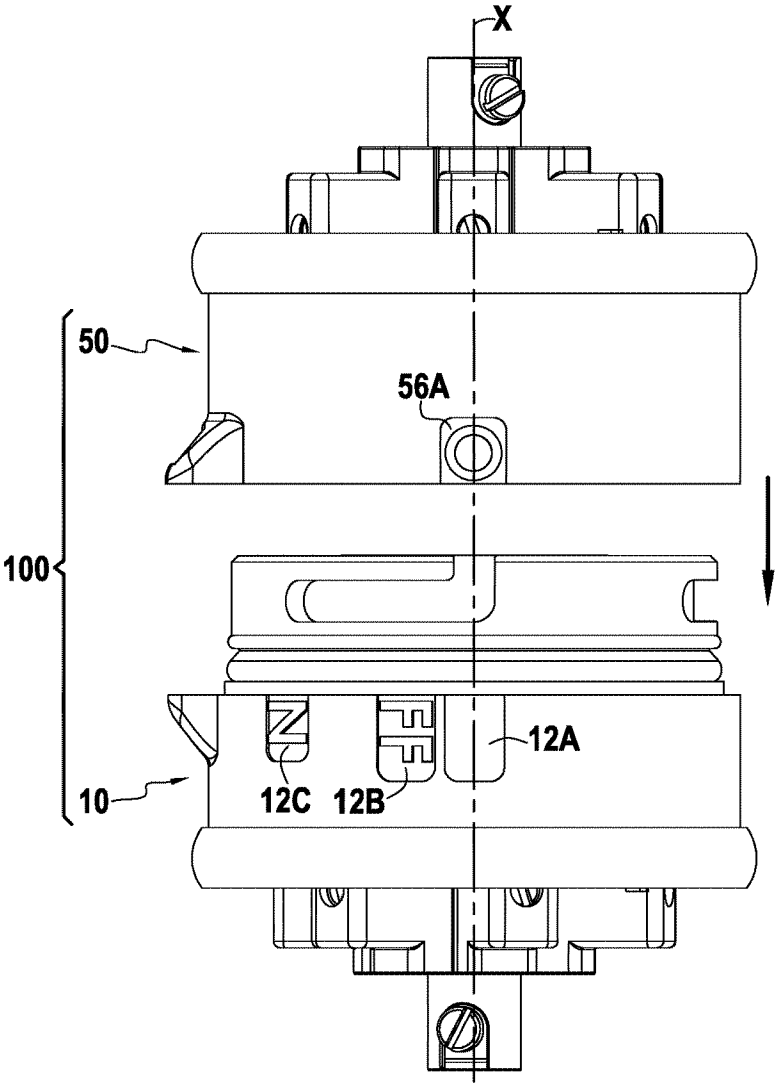
Figure 6B:
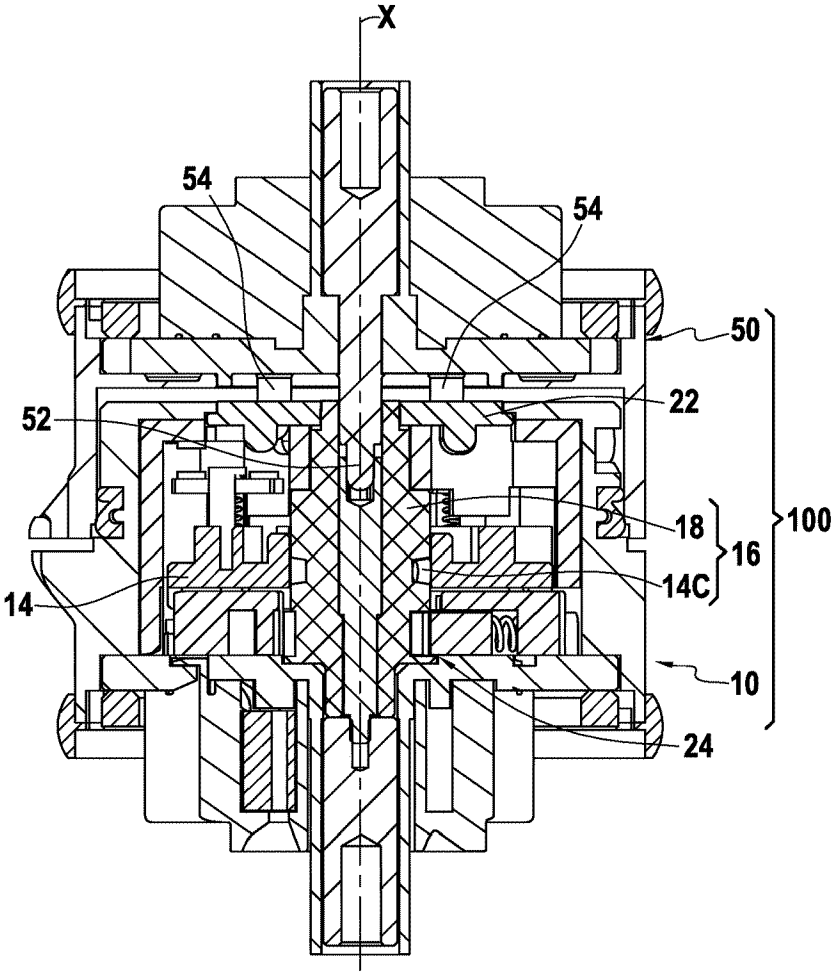
Figure 6A:
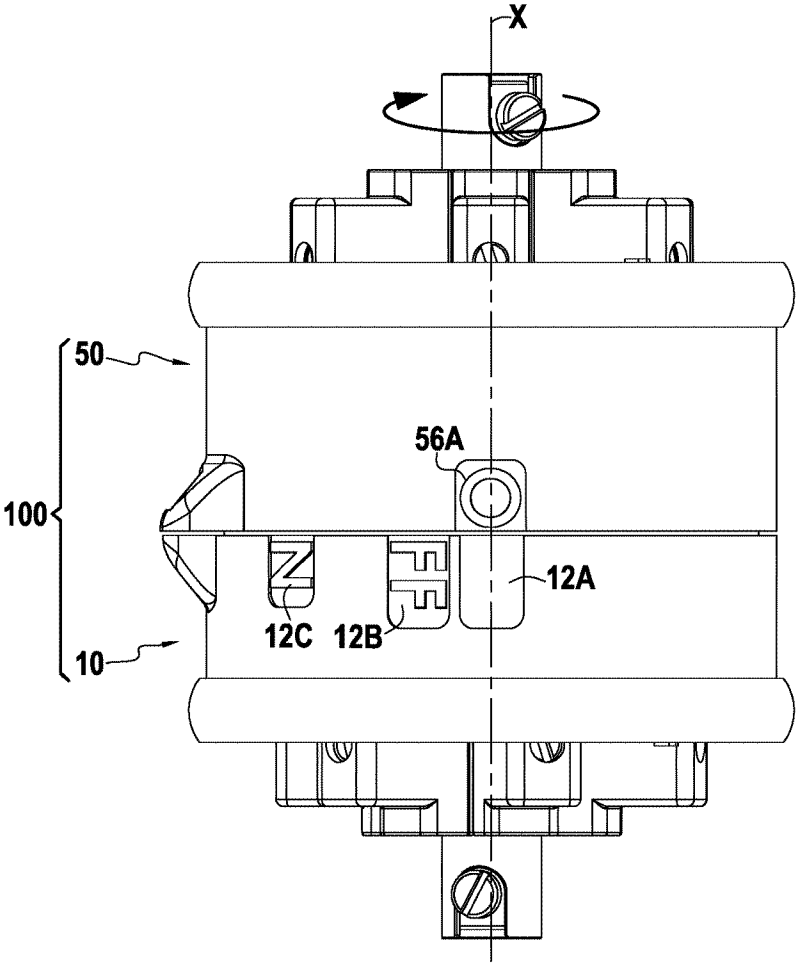
Figure 7B:
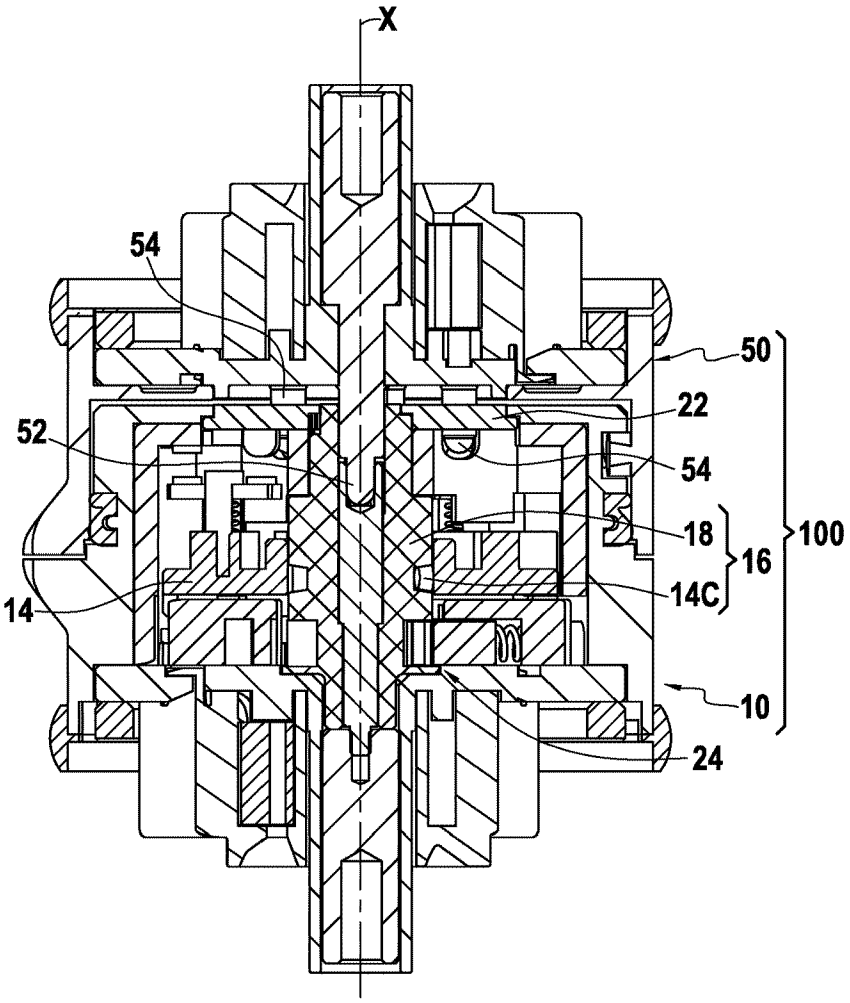
Figure 7A:
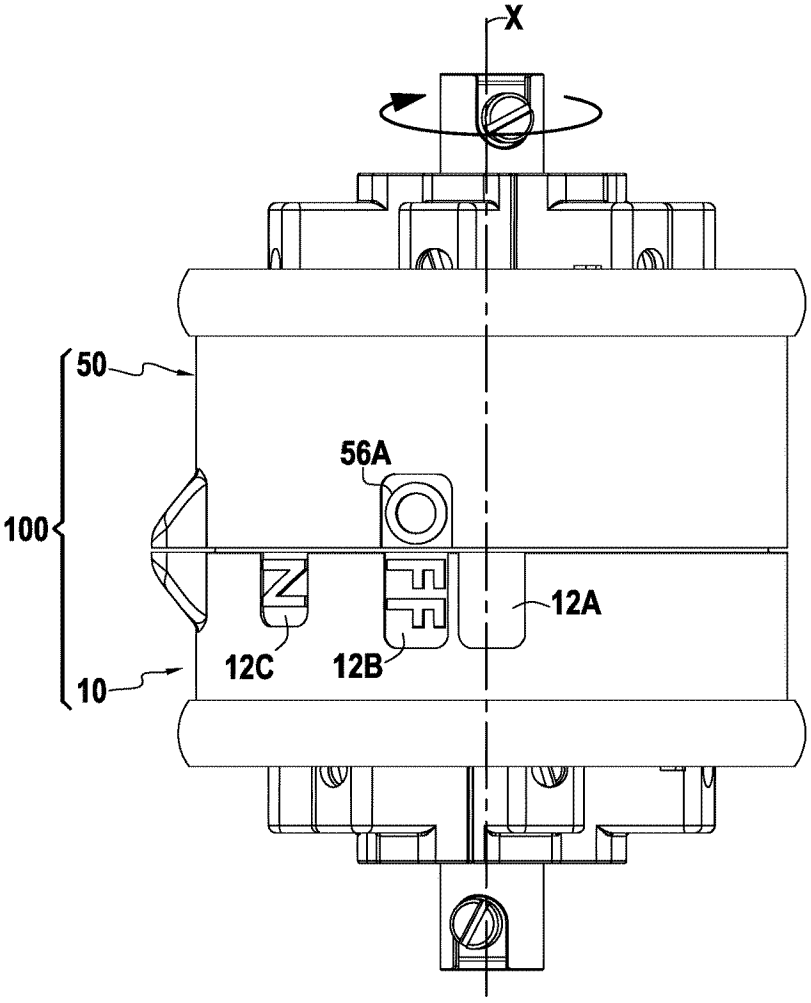
Figure 8B:
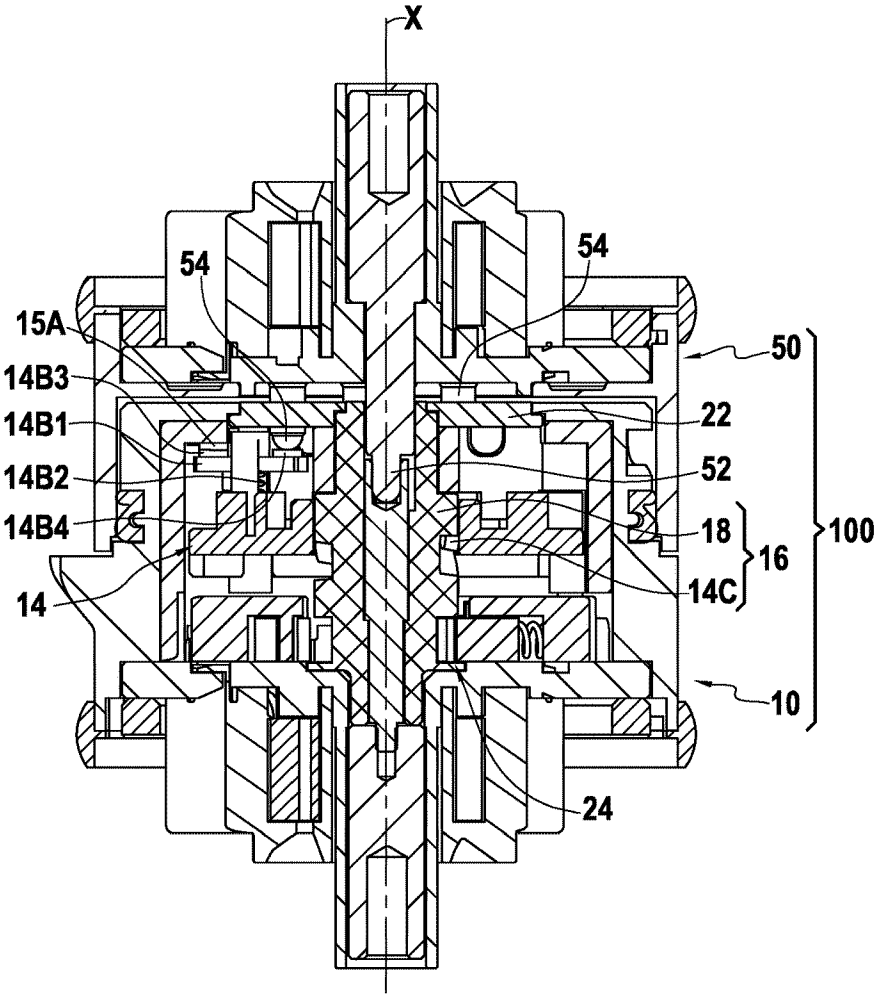
Figure 8A:
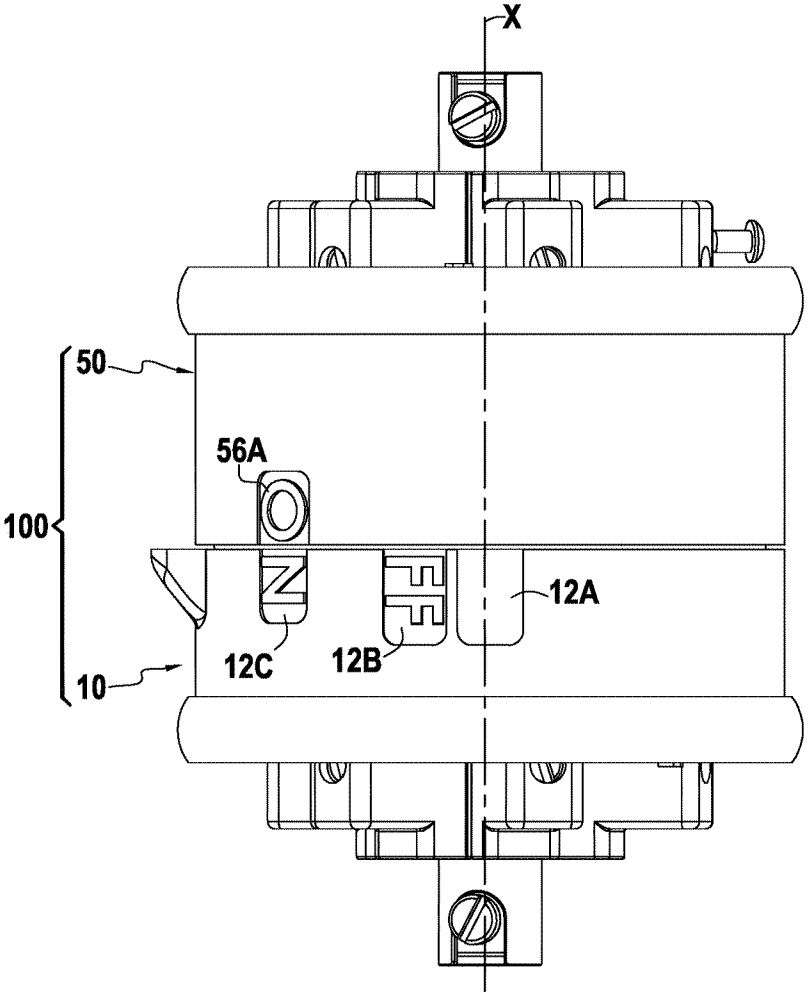
Figure 9:
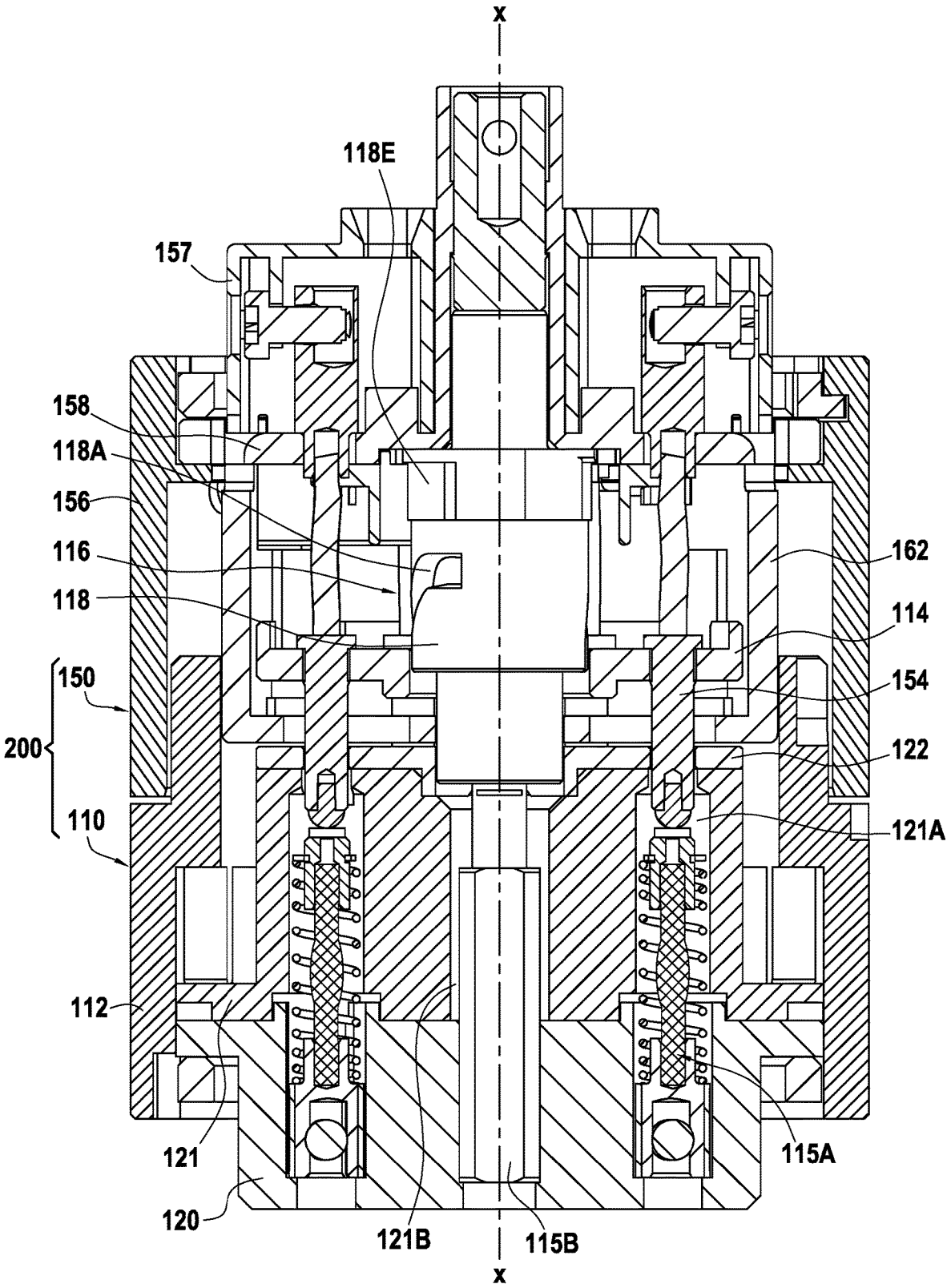
Figure 10:
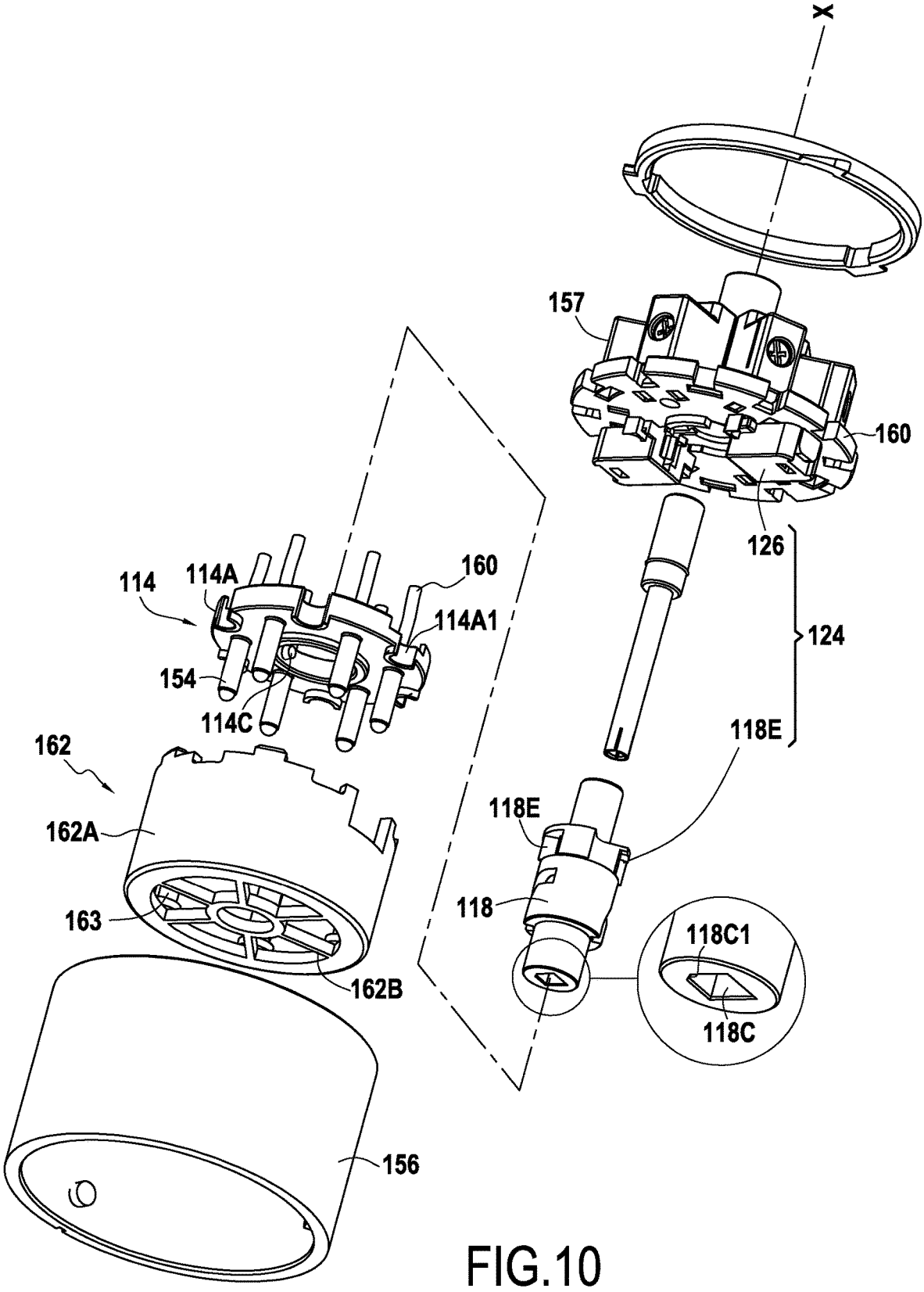

FIG. 3 represents an exploded view of the socket-outlet of the first embodiment, FIG. 4 is a sectional view along the plane IV of FIG. 3, FIGS. 5A and 5B represent the socket-outlet and the plug of the first embodiment approaching each other, FIG. 5B being an axial sectional view of FIG. 5A, FIGS. 6A and 6B represent the socket-outlet and the plug of the first embodiment engaged with each other, FIG. 6B being an axial sectional view of FIG. 6A, FIGS. 7A and 7B represent the socket-outlet and the plug of the first embodiment in the disconnected position, FIG. 7B being an axial sectional view of FIG. 7A, FIGS. 8A and 8B represent the socket-outlet and the plug of the first embodiment in the connected position, FIG. 8B being an axial sectional view of FIG. 8A, FIG. 9 represents an assembly comprising a socket-outlet and a plug according to a second embodiment, viewed in axial section, and FIG. 10 represents an exploded view of the plug of the second embodiment of FIG. 9.

DETAILED DESCRIPTION OF EXEMPLARY EMBODIMENTS

FIG. 1 represents an assembly 100 according to a first embodiment comprising a socket-outlet 10, forming in this example a power connection mount and a plug 50, forming in this example a complementary power connection mount. The socket-outlet 10 and the plug 50 each extend along an axial direction X, this direction X corresponding to the direction of fitting (or engagement) of the socket-outlet 10 and of the plug 50. In this example, the socket-outlet 10 and the plug 50 have an annular structure of axis X (the axis X defining in this example the axial direction X). In FIG. 1, the socket-outlet 10 and the plug 50 are disjoint and therefore not engaged with each other, so that the axial directions X of each of the mounts do not coincide, but these directions coincide, of course, when these mounts cooperate (see for example FIG. 2). In this example, the socket-outlet 10 and the plug 50 are each equipped with a handle 80, thereby forming respectively a socket 10A and a plug 50A, the socket 10A and plug 50A assembly forming an extender 100A. Of course, this example is not limiting and any other configuration is possible for the assembly 100, and more particularly for the socket-outlet 10 on the one hand and the plug 50 on the other hand.

In this example, the plug 50 comprises a central spindle 52 and six peripheral spindles 54, these spindles forming, within the meaning of the present invention, complementary contacts, while the socket-outlet 10 comprises as many corresponding orifices, namely a central orifice 22B and six peripheral orifices 22C. Of course, this number of spindles and orifices is not limiting, the assembly 100 being able to comprise more or less than seven spindles/orifices. In this example, the central spindle is earthed (i.e. ground spindle) while the peripheral spindles 54 are each connected to a different phase (i.e. phase spindles). In this example, the socket-outlet 10 and the plug 50 are of the end-contact type.

The socket-outlet 10 comprises a casing 12 having three position indicators for indicating the relative azimuth position of the socket-outlet 10 relative to the plug 50, namely a fitting (or engagement) position indicator 12A, a disconnected position indicator 12B and a connected position indicator 12C. These indicators are respectively formed in this example by a rectangular relief 12A, a relief writing "FF" 12B and a relief writing "N" 12C. These indicators 12A, 12B and 12C may of course have a color different from the color of the casing 12, but not necessarily.

The plug 50 comprises a casing 56 having an index 56A for indicating the relative azimuth position of the plug 50 relative to the socket-outlet 10. In this example, the index is formed by relief writing "O" 56A. This index 56A may of course have a color different from the color of the casing 56, but not necessarily. For example, the indicators 12A, 12B and 12C and the index 56 may have the same color, this color being distinct from the color of the casings 12 and 56.

These indicators and index form a use help. Thus, to fit or engage the plug 50 with the socket-outlet 10, the index 56A is azimuthally aligned with the indicator 12A (see FIGS. 5A and 6A). To put the assembly 100 into the disconnected position, the mounts 10 and 50 are rotated relative to each other so as to azimuthally align the index 56A and the indicator 12B (see FIG. 7A). Note that in this configuration, the index 56A and the indicator 12B form the word "OFF", namely "disconnected". To put the assembly 100 into the connected position, the mounts 10 and 50 are rotated relative to each other so as to azimuthally align the index 56A and the indicator 12C (see FIG. 8A). Note that in this configuration, the index 56A and the indicator 12C form the word "ON", namely "connected".

Thus, when the socket-outlet 10 is not engaged with the plug 50, as represented in FIGS. 1, 5A and 5B, or when it is only engaged with the plug 50 as represented in FIGS. 6A and 6B, the socket-outlet 10 is in a configuration called fitting configuration. When the mounts are fitted, and when the index 56A and the indicator 12B are aligned, the socket-outlet 10 is in a configuration called disconnection configuration. When the mounts are fitted, and when the index 56A and the indicator 12C are aligned, the socket-outlet 10 is in a configuration called connection configuration.

The casing 12 has three grooves 12D configured to each receive a pin 56B of the casing 56. This pins/grooves system forms a system for retaining the socket-outlet 10 with the plug 50. Thus, the pins 56B can be engaged/disengaged in/from the grooves 12D only in a fitting position, while when the mounts are fitted and rotated relative to each other, the pins 56B are engaged in the grooves 12D so that the plug 50 is retained along the axial direction X with the socket-outlet 10. Such a retaining system allows preventing any unwanted movement along the axial direction X between the socket-outlet 10 and the plug 50, which allows avoiding the formation of electric arcs between the spindles 54 and the active portions of the socket-outlet 10 described later. In this example, the retaining system comprises three grooves 12D and three pins 56B but may of course comprise more or less than three grooves and pins.

It is also noted that the casing 12 has two eyelets 12E and 12F while the casing 56 has an eyelet 56C to be able to lock together the socket and plugs 10 and 50 in the disconnected position (or OFF position) or in the connected position (or ON position), for example using a padlock (not represented).

The socket-outlet 10 and the plug 50 will now be described in more detail with reference to FIGS. 2 and 3. For the sake of clarity, the wires of the cables represented in FIG. 1 are not represented in FIG. 2. In FIG. 2, the socket-outlet 10 and the plug 50 are fitted.

The socket-outlet 10 comprises a movable element 14, which is movable along the axial direction X between an insulated position (see FIGS. 2, 5B, 6B, 7B, configuration of fitting and disconnection of the socket-outlet 10) and a contact position (see FIG. 8B; configuration of connection of the socket-outlet 10) thanks to a displacement mechanism 16. As will be described in more detail later, the mechanism 16 is configured to move the movable element 14 from the insulated position to the contact position and vice versa.

The movable element 14 comprises a platen 14A equipped with six separate portions 14B each configured to contact a peripheral spindle 54 of the plug 50. The platen 14A has guide portions 14A1, in this example axial grooves, configured to slidingly cooperate with complementary portions 29 (see FIG. 2), in this example of the axial ribs, of a cage 28 receiving the platen 14A. The cage 28 being fixedly mounted on the base 20 (i.e. stationary relative to the base), the platen 14A is guided in axial translation so as not to pivot about the axis X during the switching from the insulated position to the contact position, and vice versa. In other words, the platen 14A is rotatably coupled with the cage 28 and the base 20.

Each portion 14B comprises a support 14B1 mounted on a spring 14B2 (in this example an axial compression spring) and carrying two contact pads 14B3 and 14B4. The pads 14B3 and 14B4 are in electrical contact, in this example via the support 14B1 which is electrically conductive. The spring 14B2 makes it possible to exert an axial pressure on the distal end of the corresponding spindle 54, to ensure a quality end-contact. The portion 14B also comprises a guide 14B5 for guiding the support 14B1 along the axial direction X and housing the spring 14B2. Each portion 14B is received in a dedicated housing 14A1 of the platen 14A.

In this example, each support 14B1 has the shape of a rectangular plate whose long side extends radially with respect to the X axis, the pads 14B3 being disposed radially outwardly relative to the pads 14B4. The pads 14B4 are configured to come into contact with the spindles 54 of the plug 50 while the pads 14B3 are configured to come into contact with contact elements 15A of the socket-outlet 10. Thus, in this example, within the meaning of the present invention, the contact pads 14B4 form contacts while the spindles 54 form complementary contacts.

The contact elements 15A are folded metal bars, connected to wire clamps 15B on the one hand, and forming a contact shoulder perpendicular to the axial direction X in order to contact a contact 14B3 on the other hand. These contact elements 15A and the wire clamps 15B form the active portions of the socket-outlet 10. Such a configuration makes it possible to maximize the space, in particular along the azimuth direction, between the portions 14B, and therefore to minimize the risks of formation of electric arcs. In this example, the six portions 14B are equidistant and each spaced by an angle of 60° about the X axis of the adjacent portion. Thus, the six pads 14B4 are also equidistant and each spaced by an angle of 60° about the X axis of the adjacent pad 14B4. Similarly, the pads 14B3 being disposed radially outside the pads 14B3, are also equidistant and each spaced by an angle of 60° about the X axis of the adjacent pad 14B3.

Thus in this example, in the insulated position, the movable element 14 is in contact neither with the spindles 54 of the plug 50, nor with the active portions of the socket-outlet 10. In the contact position, the movable element 14 is in contact on the one hand with the active portions of the socket-outlet 10, and more particularly with the contact elements 15A, and on the other hand with the spindles 54 of the plug 50 (see FIG. 8B).

The displacement mechanism 16 comprises a shaft 18 extending axially and comprising a helical groove 18A as well as a lug 14C belonging to the movable element 14, and more particularly to the platen 14A. The lug 14C is engaged in the helical groove 18A and cooperates with the helical groove 18A so that the rotation of the shaft 18 about the X axis drives the lug 14C, and therefore the movable element 14, in translation along the axial direction X. Of course, the side walls of the helical groove 18A each form a helical ramp: one cooperating with the lug 14C to move it in a first sense along the axial direction X, and the other cooperating with the lug 14C to move it in a second sense, opposite the first sense, along the axial direction X. Of course, those skilled in the art can easily consider other variants comprising only one helical ramp and for example a spring return system.

The groove 18A has three successive portions 18A1, 18A2 and 18A3. The portion 18A1 extends perpendicular to the axial direction X. The angular extent of this portion 18A1 corresponds to the angular amplitude of the movement required for the switching from the fitting configuration to the disconnection configuration. This portion being perpendicular to the axial direction, during this movement, the movable element 14 is not moved along the axial direction X and remains in the insulated position. The portion 18A2 has an inclination less than 90° relative to the axial direction X. The angular extent of this portion corresponds to the angular amplitude of the movement required for the switching from the disconnection configuration to the connection configuration. This portion 18A2 being inclined relative to the axial direction X of an inclination comprised between 0° and 90°, the movable element 14 is moved axially from the insulated position to the contact position when switching from the disconnection configuration to the connection configuration. Conversely, the movable element 14 is moved axially from the contact position to the insulated position when switching from the connection configuration to the disconnection configuration. This portion 18A2 extends over an angle of 50° about the X axis. Thus, the relative angular travel between the socket-outlet 10 and the plug 50 to move the movable element 14 between the insulated position and the contact position is less than the minimum angle of 60° separating two adjacent pads 14B4. La portion 18A3 is opening along the axial direction X and parallel to the axial direction X. It is essentially used for the mounting of the socket-outlet 10, and allows the assembling of the movable element 14 with the shaft 18.

The shaft 18 is rotatably mounted on the base 20. More specifically, in this example, the shaft 18 is partly fitted into a bearing 20A arranged in the base 20. The shaft 18 has an axial protrusion 18D engaged in an annular groove (not represented) of the base extending over an angular extent at least equal to the total angular travel in rotation of the socket-outlet relative to the plug around the axial direction X. This protrusion 18D forms an indexing device for the assembly of the shaft 18 with the base 20 during the manufacture of the socket-outlet 10.

To be rotatably driven, the shaft 18 is hollow, and has at its distal end opposite to the end engaged in the bearing 20A, a cavity 18C of square cross-section, this square cross-section having in an angle a flat 18C1 forming an indexing device. This cavity 18C is configured to receive the central spindle 52 described later. Within the meaning of the present invention, the spindle 52 forms an example of complementary element configured to cooperate in a form-fitting manner with the shaft 18.

The shaft 18 carries a safety disk 22. The safety disk 22 is rotatably coupled with the shaft 18 by a tenon/mortise system 22A/18B. The safety disk 22 is carried by the distal end of the shaft 18, opposite to the end engaged in the bearing 20A of the base. The movable element 14 is disposed between the base 20 and the safety disc 22. The safety disc 22 has a central orifice 22B and six peripheral orifices 22C configured to receive respectively the central spindle 52 and the peripheral spindles 54 of the plug 50. The safety disk 22 has walls forming separators 22D, each being disposed on the side of the movable element 14 between two adjacent orifices 22C. These separators serve to prevent formation of electric arcs between a first spindle 54 and a pad 14B4 configured to come into contact with a second spindle 54, adjacent to the first spindle.

The safety disc 22 being carried by and rotatably coupled with the shaft 18, it is therefore rotatably movable about the X axis. When the shaft 18 is in a position such that the movable element 14 is in the insulated position, the safety disc 22 blocks access to the pads 14B4 of the movable element 14 (i.e. the orifices 22C and the pads 14B4 have a separate azimuth position and are not opposite to each other along the axial direction X). The safety disk 22 is then in the protection position. When the shaft 18 is in a position such that the movable element 14 is in the contact position, the safety disk 22 authorizes access to the pads 14B4 of the movable element 14 (i.e. the orifices 22C and the pads 14B4 have the same azimuth position and are opposite to each other along the axial direction X). The safety disk 22 is then in the connection position.

The socket-outlet 10 comprises a holding device 24 for holding in position the movable element 14. This holding device 24 comprises two similar cams 18E and disposed at 180° from each other with respect to the axis of the shaft 18, and two similar pressing elements 26, each pressing element 26 cooperating with a cam 18E. The pressing elements 26 are fixed to the base 20, and are therefore stationary relative to the shaft 18, and therefore relative to the cams 18E.

The cams 18E and the pressing elements 26 are described in more detail with reference to FIG. 4. The two cams and the two pressers being identical, only one pair cam/presser is described. Of course, the present example comprises two pairs cam/presser, but could of course comprise only one pair, or more than two pairs.

The cam 18E extends azimuthally between two abutments 19A and 19B and has two teeth 18E1 and 18E2. The pressing element 26 has a needle 26A mounted on a spring 26B which radially presses the needle 26A against the cam 18E. The needle 26A, and more generally the pressing element 26, cooperates in a form-fitting manner with the cam 18E. Thus, the pressing element 26 provides a certain resistance when it is desired to rotate the shaft 18, this resistance resulting from the passage of the needle 26A on the teeth 18E1 or 18E2. The first tooth 18E1 is smaller than the second tooth 18E2, so that the resistance provided to pass the first tooth 18E1 is less than the resistance provided to pass the second tooth 18E2.

When the needle 26A is disposed between the abutment 19A and the first tooth 18E1, the plug 10 is in fitting configuration, the movable element 14 being in the insulated position (the lug 14C being disposed in the portion 18A1 of the helical groove 18A). When the needle 26A is between the first tooth 18E1 and the second tooth 18E2, the plug 10 is in the disconnection configuration, the movable element 14 being in the insulated position (the lug 14C being disposed in the portion 18A1 of the helical groove 18A, in the vicinity of the inclined portion 18A2). When the needle 26B is disposed between the second tooth 18E2 and the abutment 19B, the plug 10 is in connection configuration, the movable element 14 being in the contact position (the lug 14C being in the portion 18A2 of the helical groove 18A).

Thus, thanks to the teeth 18E1 and 18E2 and to the pressing element 26, only the configurations taken by the socket-outlet 10 when the needle 26A is between the abutment 19A and the first tooth 18E1, between the first and second teeth 18E1 and 18E2 and between the second tooth 18E2 and the abutment 19B, are stable configurations. All configurations taken by the socket-outlet 10 when the needle cooperates with one side or the vertex of a tooth 18E1 or 18E2 are unstable configurations. Indeed, in the latter case, the pressing element 26 exerts a radial pressure tending to rotate the cam 18E about the X axis so as to return into a stable position where the pressing element 26 is between two teeth or between a tooth and an abutment. Of course, those skilled in the art can use any other known system that makes it possible to obtain a similar stability of the different configurations, namely a minima a first stable configuration in which the movable element is in the contact position (i.e. stable connection configuration), a second stable configuration in which the movable element is in the insulated position (i.e. stable disconnection configuration), and a plurality of unstable intermediate configurations between the first configuration and the second configuration in which the socket-outlet tends to come in the first configuration or in the second configuration.

It is therefore understood that the pressing element 26 holds in position the shaft 18 so that the needle 26A is disposed between two teeth or between a tooth and an abutment, and opposes the movements tending to release the needle from these positions. By holding the shaft 18 in predetermined positions (i.e. azimuth position where the needle 26A is disposed between two teeth or between a tooth and an abutment), the cam 18E and the pressing element 26 make it possible to hold the movable element 14 either in the contact position, or in the insulated position. It is noted that the passage of the second tooth 18E2 requires a voluntary displacement on the part of the user to reach the vertex of the second tooth 18E2. Beyond this vertex, the holding device 26 assists the user and the end of the movement is done automatically. The speed of rotation of the shaft, and therefore the speed of displacement along the axial direction of the movable element 14, is a function of this second phase, of the pressure exerted by the pressing element 26 on the cam 18. It is thus possible to control this speed, and therefore the formation of electric arcs upon connection/disconnection of the pads 14B4 with the spindles 54.

Moreover, the first tooth 18E1 makes it possible to offer a certain resistance during the switching from the fitting configuration to the disconnection position and vice versa. This provides some safety for the user. Indeed, when the mounts are mounted within an extender as illustrated in FIG. 1 and when the socket-outlet 10 is in a disconnection position, the mounts can undergo a certain torsional stress through the electrical cables to which they are connected. These stresses could lead to bringing the socket-outlet in the fitting configuration, so that the socket-outlet 10 could disengage from the plug 50, which is undesirable. Thus, the resistance provided by the first tooth 18E1 allows avoiding this risk.

Generally, it is noted that the base 20 forms a stationary element of the socket-outlet 10. The base 20 receives from a first side the wire clamps 15B, as well as a central wire clamp 15C connected a honeycomb central contact 15D configured to receive the end of the central spindle 52. The spindle 52 being earthed, the central contact 15D is obviously also earthed (i.e. ground contact). The base 20 receives on a second side, opposite along the axial direction X to the first side, the feed mechanism 16 and the position holding device 24. This second side of the base 20 also receives a cage 28 housing the movable element 14 and used as a bearing for the safety disc 22. The contact elements 15A are disposed outside the cage 28. All this assembly is received in the casing 12, the base 20 being blocked within the casing 12 by a bushing 30 and stationary within the casing 12. In other words, the base 20 is coupled to the casing 12. The casing 12 is equipped with a seal 32 to ensure a certain level of water and foreign body tightness when the socket-outlet 10 is assembled with the plug 50.

The cage 28 has a cylindrical portion 28A of X axis configured to guide the platen 14A axially between the insulated position and the contact position and a perforated portion 28B, transverse to the axial direction X, to allow the passage of the spindles 52 and 54.

The plug 50 comprises a central spindle 52 which forms an actuator configured to actuate the displacement mechanism 16 of the movable element 14 of the socket-outlet 10. In this example, the central spindle 52 is formed by a rod extending axially. More specifically, the central spindle 52 has a square section, a corner of which has a flat 52A forming an indexing device. This spindle 52 is configured to be engaged in the cavity 18C of the shaft 18 and cooperates in a form-fitting manner with the walls of this cavity 18C. In other words, in this example, the central spindle 52 forms a complementary element configured to cooperate in a form-fitting manner with the shaft 18. Thus, when the socket-outlet 10 is engaged with the plug 50, the spindle 52 is fitted into the shaft 18 and rotatably coupled with the shaft 18. Thus, when the socket-outlet 10 and the plug 50 are rotated relative to each other about the X axis, the spindle 52 rotatably drives the shaft 18, whereby the displacement mechanism 16 of the movable element 14 is actuated.

The different use phases of the socket-outlet 10 and of the plug 50 will now be described with reference to FIGS. 5A to 8B. For the sake of clarity, the wires of the cables represented in FIG. 1 are not represented.

In FIGS. 5A and 5B, the socket-outlet 10 and the plug 50 are separated and approaching each other along the axial direction X. The socket-outlet 10 is in the fitting configuration, the movable element 14 being in the insulated position and the needle 26A of the two pressing elements 26 being disposed between the abutment 19A and the first tooth 18E1. The bold arrow indicates the movement of engagement of the socket-outlet 10 and of the plug 50. As indicated above, to fit the plug 50 with the socket-outlet 10, the index 56A is azimuthally aligned with the indicator 12A as represented in FIG. 5A. Of course, the socket-outlet 10 and the plug 50 are configured such that when the index 56A and the indicator 12A are azimutally aligned, the pins 56B are aligned with the inlets of the grooves 12D, and the indexing device 52A of the spindle 52 is aligned with the indexing device 18C1 of the displacement mechanism 26. The orifices 22C of the safety disc 22 are also azimuthally aligned with the peripheral spindles 54.

Thus, by fitting the socket-outlet 10 and the plug 50 in this way, these are engaged with each other. It will be noted that generally, within the meaning of the present disclosure, the mounts are considered to be engaged with each other when the actuator of the plug and the displacement mechanism of the socket-outlet cooperate in such a way as to be able to actuate the displacement mechanism (i.e. in the present example, the spindle 52 is engaged in the shaft 18). Thus, it is understood that the pins 56B and the grooves 12D are optional.

In FIGS. 6A and 6B, the socket-outlet 10 and the plug 50 are engaged with each other. The spindle 52 extends through the orifice 22B and is fitted into the cavity 18C of the shaft 18. The spindles 54 extend through orifices 22C. The socket-outlet 10 is in fitting configuration, the movable element 14 being in the insulated position and the needle 26A of the two pressing elements 26 being disposed between the abutment 19A and the first tooth 18E1. The central spindle 52 is in electrical contact with the central contact 15D while the movable element 22 is remote from peripheral spindles 54 and contact elements 15A.

By rotating the socket-outlet 10 and the plug 50 relative to each other about the X axis, so as to bring the index 56A onto the indicator 12B (see bold arrow in FIG. 6A), the plug 10 is brought into the disconnected configuration represented in FIGS. 7A and 7B. The spindle 52 has rotatably driven the shaft 18 about the X axis, so that the needle 26A of the two pressing elements 26 is disposed between the first tooth 18E1 and the second tooth 18E2. The lug 14C is at the foot of the inclined portion 18A2 of the helical groove 18A. The movable element 14 is therefore always in the insulated position and remains remote from the peripheral spindles 54 and contact elements 15A. The central spindle 52 is always in electrical contact with the central contact 15D. In addition, the peripheral spindles 54 have followed the rotational movement and have driven the safety disk 22. Thus, the spindles 14 have moved closer according to the azimuth direction of their respective pads 14B4 but are still not aligned azimuthally with the pads 14B4.

By rotating the socket-outlet 10 and the plug 50 relative to each other about the X axis, so as to bring the index 56A onto the indicator 12C (see bold arrow in FIG. 7A), the plug 10 is brought into the connected configuration represented in FIGS. 8A and 8B. The spindle 52 has rotatably driven the shaft 18 about the X axis, so that the needle 26A of the two pressing elements 26 is disposed between the second tooth 18E2 and the abutment 19B. The lug 14C has been driven along the direction X by the inclined portion 18A2 of the helical groove 18A, so that the movable element 14 is switched from the insulated position to the contact position. The pads 14B4 are in contact with the spindles 54 which, thanks to this latter rotation, are aligned azimuthally with the pads 14B4. In addition, the pads 14B3 are in contact with the contact elements 15A. The supports 14B1 being electrical current conductors, the spindles 54 are thus in contact with the active portions of the socket-outlet 10. It is noted that the springs 14B2 supporting the supports 14B1 are compressed and thus exert a certain pressure according to the axial direction on the spindles 54 and the contact elements 15A, via the pads 14B3 and 14B4.

Thanks to the displacement mechanism 16 of the movable element 22 and to the mechanism for holding in position 24 the movable element 22, the contact between the active portions of the socket-outlet 10 and the spindles 54 of the plug 50 is perfectly controlled and independent of the speed of fitting of the two mounts. In this example, the contact is made during the switching from the configuration of disconnection to the configuration of connection of the socket-outlet 10. The axial distance separating the pads 14B4 from the spindles 54 in the insulated position is of at least 6 mm. Thus, the risk of formation of electric arcs upon connection is avoided, at the very least minimal.

Of course, to bring the socket-outlet 10 into the disconnected configuration, then into the fitting configuration, and finally to disengage the two mounts from each other, the relative movements between the two mounts opposite to those described above with reference to FIGS. 5A to 8B are operated. In the same manner as described above, the disconnection speed is identical to the connection speed, so that the risk of formation of electric arcs upon disconnection is also avoided, at the very least minimal.

A second embodiment will now be described with reference to FIGS. 9 and 10. FIG. 9 represents an assembly 200 comprising a socket-outlet 110, forming in this example a complementary power connection mount, and a plug 150, forming in this example a power connection mount. In other words, in comparison with the first embodiment, the socket-outlet 110 comprises an actuator for actuating a displacement mechanism of a movable element of the plug 150 while in the first embodiment, it is the plug 50 that comprises an actuator for actuating a displacement mechanism of a movable element of the socket-outlet 10. It is noted that in this example, the displacement mechanism of the movable element and the position holding device are identical between the first embodiment and the second embodiment. Only the movable element changes: instead of carrying contact pads as in the first embodiment, it carries spindles. It is noted that in FIGS. 9 and 10, the mounts are not equipped with a handle, but can of course be equipped therewith.

The casings 112 and 156 of the socket-outlets 110 and of the connector 150 are similar to the casings 12 and 56 of the mounts 10 and 50 of the first embodiment, with the exception of the locking eyelets which are not provided. Of course, the indicators and index are present, although they are not visible in the figures.

The socket-outlet 110 comprises an isolating body 121 mounted on a base 120 which are fixed relative to the casing 112. The body 121 and the base 120 form six peripheral housings 121A each receiving an end-contact braid 115A, these braids 115A being configured to make an end-contact with the spindles 154 described later. Of course, according to one variant, there are more or less of six peripheral housings equipped with a braid. The braids 115A form, within the meaning of the present invention, complementary contacts. A central housing 121B receives a central spindle 115B. This central spindle 115B is similar to the spindle 52 of the plug 50 of the first embodiment, and serves as an actuator for actuating the displacement mechanism (described later) of the plug 150. The spindle 115B has in particular an indexing device, not represented, similar to the indexing device 52A, which cooperates with an indexing device 118C described later. The socket-outlet 110 also comprises a safety disk 122, similar to the safety disk 22 of the socket-outlet 10 of the first embodiment. The safety disc 22 is rotatably mounted on the isolating body 121, and is rotatably driven between the protection position and the connection position by the spindles 154 of the plug 150.

The plug 150 comprises a movable element 114, which is movable along the axial direction X between an insulated position (not represented) and a contact position (position represented in FIG. 9) thanks to a displacement mechanism 116. In a manner comparable to the displacement mechanism 16 of the first embodiment, the mechanism 116 of the second embodiment is configured to move the movable element 114 from the insulated position to the contact position and vice versa.

The movable element 114 comprises a platen 114A equipped with six separate spindles 154 each configured to contact a braid 115A of the socket-outlet 110. Of course, according to one variant, there are more or less of six spindles. The spindles 154 are of course secured to the platen 114A. The spindles 154 form, within the meaning of the present invention, contacts. Each spindle 154 is electrically connected to a wire clamp 157, mounted on the base 158, by a flexible wire 160. Of course, it is understood that, when the platen 114A moves axially, it drives the spindles 154, while the wire clamps 157 remain in position relative to the base 160, the flexible wires fold/unfold to follow the movements of the platen 114A. Thus, by "flexible wire" is meant a wire capable of being deformed as a function of the axial displacements of the movable element 114. Consequently, in this example, the spindles of the movable element are in permanent contact with the wire clamps.

In a manner similar to the platen 14A of the first embodiment, the platen 114A has guide portions 114A1, in this example axial grooves, configured to slidingly cooperate with complementary portions 163, in these example ribs, of a cage 162 receiving the platen 114A. In a manner similar to the cage 28 of the first embodiment, the cage 162 has a cylindrical portion 162A of X axis configured to guide the platen 114A axially between the insulated position and the contact position and a perforated portion 114B, transverse to the axial direction X, to allow the passage of the spindles 115B and 154.

In a manner similar to the displacement mechanism 16 of the first embodiment, the displacement mechanism 116 comprises an axially extending shaft 118 comprising a helical groove 118A as well as a lug 114C (see FIG. 10) belonging to the movable element 114, and more particularly to the platen 114A. The shaft 118, and in particular the groove 118A, is strictly similar to the shaft 18 of the first embodiment, and in particular the groove 18A, and is therefore not described again.

The shaft 118 is rotatably mounted on the base 160 in a manner similar to the first embodiment. To be rotatably driven, the shaft 118 is hollow and has, at its opposite distal end engaged with the base 160, a cavity 118C of square cross-section, this square cross-section having at one angle a flat 118C1 forming an indexing device. This cavity 118C is configured to receive the central spindle 115B of the socket-outlet 110.

The plug 150 also comprises a position holding device 124 to hold in position the movable element 114. This holding device 124 comprises two similar cams 118E disposed at 180° from each other with respect to the axis of the shaft 118, and two similar pressers 126, each pressing element 126 cooperating with a cam 118E. The pressing elements 126 are fixed to the base 160, and are therefore stationary relative to the shaft 118, and therefore relative to the cams 118E. The pressing elements 126 and the cams 118E are strictly similar to the pressing elements 26 and cams 18E of the first embodiment, and are therefore not described again.

The different use phases of the socket-outlet 110 and of the plug 150 are similar to the use phases of the socket-outlet 10 and of the plug 50 of the first embodiment, and are therefore not described again. Of course, instead of bringing pads 14B4 in contact with the spindles 54 from the insulated position to the contact position, in the second embodiment, the movable element 114 brings the spindles 154 in contact with the braids 115A. The kinematics of all the other elements however remains quite comparable between the first and second embodiments.

It is generally understood that the socket-outlet 10 of the first embodiment and the plug 150 of the second embodiment form electrical connection mounts which respectively comprise contacts 14B4 and 154 configured to contact complementary contacts, respectively 54 and 115A, of the plug 150 of the first embodiment and of the socket-outlet 110 of the second embodiment which form complementary electrical connection mounts.

Although the present invention has been described with reference to specific exemplary embodiments, it is obvious that modifications and changes can be made to these examples without departing from the general scope of the invention as defined by the claims. Particularly, individual characteristics of the various illustrated/mentioned embodiments can be combined in additional embodiments. Accordingly, the description and drawings should be considered within an illustrative rather than restrictive meaning.

The invention claimed is:

1. An assembly comprising:

an electrical connection mount extending along an axial direction the electrical connection mount including a casing that extends along the axial direction, a movable element provided at least partially within the casing, the movable element being movable along the axial direction between a contact position and an insulated position, and a displacement mechanism that moves the movable element between the contact position and the insulated position;

wherein the movable element comes into contact with at least one complementary contact of a complementary electrical connection mount when the movable element is in the contact position, and the movable element is remote from the at least one complementary contact of the complementary electrical connection mount when the movable element is in the insulated position, wherein the displacement mechanism moves the moveable element relative to the casing along the axial direction toward the at least one complementary contact of the complementary electrical connection mount when the electrical connection mount and the complementary electrical connection mount are engaged with each other and rotated relative to each other around the axial direction, and wherein the complementary electrical connection mount extends along the axial direction and comprises an actuator that actuates the displacement mechanism of the movable element of the electrical connection mount when the complementary electrical connection mount and the electrical connection mount are engaged with each other and rotated relative to each other around the axial direction.

2. A complementary electrical connection mount comprising:

a casing extending along an axial direction;

an actuator that actuates a displacement mechanism of a movable element of an electrical connection mount when the complementary electrical connection mount and the electrical connection mount are engaged with each other and rotated relative to each other around the axial direction, the movable element being movable along the axial direction between a contact position and an insulated position, the movable element being remote from at least one complementary contact of the complementary electrical connection mount when the movable element is in the insulated position, and the movable element establishing an electrical contact with the at least one complementary contact of the complementary electrical connection mount when the movable element is in the contact position by being moved from the insulated position to the contact position by the moveable element being moved relative to the casing along the axial direction and toward the at least one complementary contact of the complementary electrical connection mount when the electrical connection mount and the complementary electrical connection mount are engaged with each other and rotated relative to each other around the axial direction.

3. The complementary electrical connection mount according to claim 2, wherein the actuator cooperates in a form-fitting manner with an axially extending shaft of the displacement mechanism of the electrical connection mount and to rotatably drive the shaft in rotation around the axial direction.

4. The complementary electrical connection mount according to claim 2, wherein the actuator comprises an indexing device.

5. The complementary electrical connection mount according to claim 2, comprising an index configured to indicate a relative azimuth position of the complementary electrical connection mount relative to the electrical connection mount.

6. An electrical connection mount comprising:

a casing extending along an axial direction;

a movable element provided at least partially within the casing, the movable element being movable along the axial direction between a contact position and an insulated position; and a displacement mechanism that moves the movable element between the contact position and the insulated position, wherein the movable element comes into contact with at least one complementary contact of a complementary electrical connection mount when the movable element is in the contact position, and the movable element is remote from the at least one complementary contact of the complementary electrical connection mount when the movable element is in the insulated position, and wherein the displacement mechanism moves the moveable element from the insulated position to the contact position by moving the moveable element relative to the casing along the axial direction toward the at least one complementary contact of the complementary electrical connection mount when the electrical connection mount and the complementary electrical connection mount are engaged with each other and rotated relative to each other around the axial direction.

7. The electrical connection mount according to claim 6, wherein the displacement mechanism comprises a shaft extending axially and rotatably mounted around the axial direction on a base, the shaft comprising one element among a helical ramp and a lug, the movable element having another element among the helical ramp and the lug, the lug cooperating with the helical ramp.

8. The electrical connection mount according to claim 7, wherein the shaft cooperates in a form-fitting manner with a complementary element of the complementary electrical connection mount and to be rotatably driven around the axial direction by the complementary element of the complementary electrical connection mount.

9. The electrical connection mount according to claim 7, wherein the displacement mechanism comprises an indexing device.

10. The electrical connection mount according to claim 7, comprising a device for holding in position the movable element, wherein the device for holding in position the movable element comprises a cam carried by the shaft, and a pressing element cooperating with the cam.

11. The electrical connection mount according to claim 7, wherein the movable element comprises at least one contact configured to contact the at least one complementary contact of the complementary electrical connection mount, and comprising a safety disc rotatably movable between a protection position preventing access to said at least one contact and a connection position authorizing access to said at least one contact, the safety disk being rotatably coupled with the shaft.

12. The electrical connection mount according to claim 6, comprising a device for holding in position the movable element.

13. The electrical connection mount according to claim 6, having a first stable configuration in which the movable element is in the contact position, a second stable configuration in which the movable element is in the insulated position, and a plurality of unstable intermediate configurations between the first configuration and the second configuration in which the electrical connection mount tends to come into the first configuration or into the second configuration.

14. The electrical connection mount according to claim 6, wherein the movable element comprises a plurality of contacts configured to contact the at least one complementary contact of the complementary electrical connection mount, a relative angular travel between the electrical connection mount and the complementary electrical connection mount to move the movable element between the insulated position and the contact position being less than a minimum angle separating two adjacent contacts.

15. The electrical connection mount according to claim 6, wherein the movable element comprises at least one contact configured to contact the at least one complementary contact of the complementary electrical connection mount, and comprising a safety disc rotatably movable between a protection position preventing access to said at least one contact and a connection position authorizing access to said at least one contact.

16. The electrical connection mount according to claim 6, comprising at least two separate position indicators configured to indicate a relative azimuth position of the electrical connection mount relative to the complementary electrical connection mount.

* * * * *